US006684772B2

(12) United States Patent
Harte

(10) Patent No.: US 6,684,772 B2
(45) Date of Patent: Feb. 3, 2004

(54) FLEXOGRAPHIC PRINTING MACHINE

(75) Inventor: Ulrich Harte, Ibbenbueren (DE)

(73) Assignee: Windmoeller & Hoelscher, Lengerich (DE)

( * ) Notice: Subject to any disclaimer, the term of this patent is extended or adjusted under 35 U.S.C. 154(b) by 0 days.

(21) Appl. No.: 10/187,373

(22) Filed: Jul. 2, 2002

(65) Prior Publication Data

US 2003/0019374 A1 Jan. 30, 2003

(30) Foreign Application Priority Data

Jul. 26, 2001 (DE) ..... 101 36 401

(51) Int. Cl.[7] ..... B41F 5/18
(52) U.S. Cl. ..... 101/181; 101/183
(58) Field of Search ..... 101/176, 177, 101/178, 136, 137, 138, 139, 140, 181, 183

(56) References Cited

FOREIGN PATENT DOCUMENTS

| | | |
|---|---|---|
| DE | 29 41 521 | 4/1981 |
| DE | 34 32 572 | 3/1985 |
| DE | 34 37 216 | 4/1986 |
| DE | 37 42 129 | 6/1989 |
| DE | 40 01 735 | 7/1991 |

*Primary Examiner*—Daniel J. Colilla
(74) *Attorney, Agent, or Firm*—Jacobson Holman PLLC

(57) ABSTRACT

A flexographic printing machine having a counter pressure cylinder, which is mounted in a printing machine frame and is intended for several printing units, each printing unit including a printing roller and related inking unit disposed on a bracket in such a manner that each printing unit can be moved in relation to the others and can engage with the counter pressure cylinder. To set arbitrary lengths of print, the brackets are held movably in a guide ring on the printing machine frame which is concentric to the axis of the counter pressure cylinder and can be fixed in desired positions along the guide ring.

3 Claims, 4 Drawing Sheets

4
4
4
4
13
12
3

4
4
20
10
21
21

FLEXOGRAPHIC PRINTING MACHINE

BACKGROUND OF THE INVENTION

1. Field of the Invention

The invention relates to a flexographic printing machine comprising a counter pressure cylinder, which is mounted in a printing machine frame and is intended for several printing units, which comprise printing rollers and related inking units, preferably engraved rollers with inking chamber doctor blades, and are disposed on their own brackets in such a manner that each printing roller and each inking roller on each bracket can be moved in relation to each other and both of them together can engage with the counter pressure cylinder, wherein the counter pressure roller and the printing and inking unit rollers are provided with drives.

2. Description of the Related Art

Flexographic printing machines of this type are known, for example, from the DE 29 41 521 A1, DE 34 37 216 C2, DE 37 42 129 A1 and DE 40 01 735 A1. In these prior art flexographic printing machines the brackets, bearing the inking units and the printing rollers, are connected securely to the machine frame so that in principle the possible lengths of the print are a function of the distance between the brackets or the distance between the printing rollers, measured over the circumference of the counter pressure roller. Longer printing lengths are possible only if individual printing units are put out of service.

SUMMARY OF THE INVENTION

The object of the invention is to provide a flexographic printing machine of the type described in the introductory part, with which arbitrary lengths of print can be set.

The invention solves this problem associated with a flexographic printing machine of the type described in the introductory part in that the brackets are held moveably in such a manner in guides of the printing machine frame or in guides connected to them and can be fixed in desired positions such that during displacement the axes of the printing rollers lie on the guides, which are concentric to the axis of the counter pressure cylinder.

The flexographic printing machine of the invention can be set in a simple manner to arbitrary desired sizes of print in that the brackets of the printing units that are printing are moved a corresponding distance in relation to each other or are moved by means of special drives and are fixed in positions that are set thus. The printing units that are printing can be distributed symmetrically, for example in mirror inversion to the vertical central plane of the counter pressure roller. Owing to the corresponding device and the setting of the printing units, the central counter pressure cylinder can be used for maximum printing lengths.

Printing units, which are unnecessary and inserted in guides, can be moved with their brackets into a waiting position or parking position, where they do not print.

Since the brackets or the printing rollers can be moved concentrically to the axis of the counter pressure cylinder, the drives for the printing rollers and the inking rollers can be removed centrally by the central gearwheel, connected to the counter pressure roller. However, it is expedient both for the counter pressure cylinder and for the printing and inking unit rollers to be provided with their own drives, which enable in a simple manner the maintenance of the register. Such multiple motor drives are known, for example, from the DE 34 32 572 A1.

A preferred embodiment provides that the brackets can be inserted into guides and can be removed from the same. In this manner it is possible in a simple manner to retrofit or remove the inking units or the printing units. This design makes it possible to provide, according to the choice of the operator, the printing machine with the desired number of printing units.

Even if during the printing operation there are a large number of printing units and negligible spacing between the brackets, bearing said printing units, it is possible to increase the distance between the printing units for the purpose of maintenance and cleaning.

One embodiment of the invention is explained in detail below with reference to the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
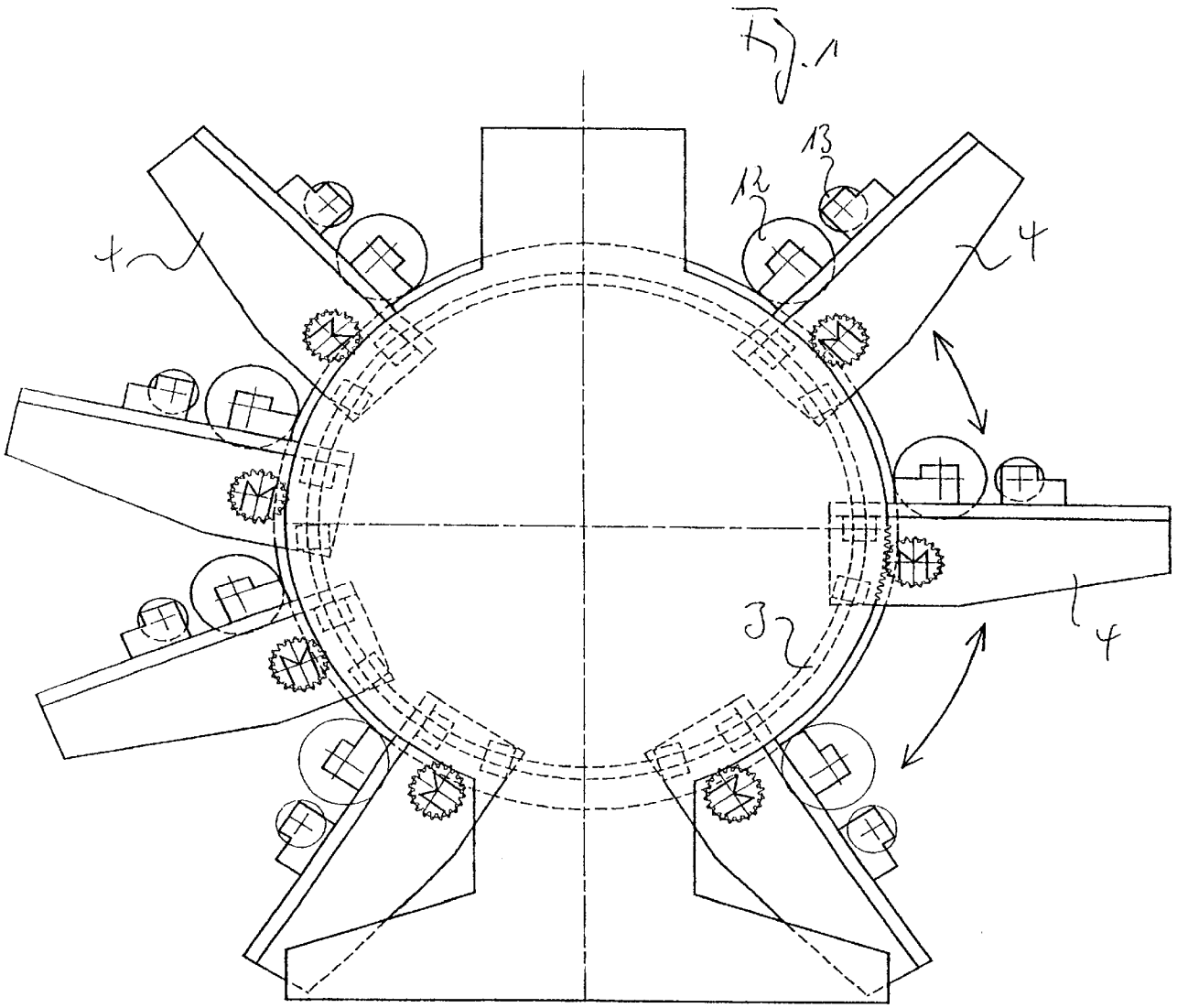
FIG. 1 is a side view of a schematic drawing of a flexographic printing machine with four movable printing units on the left side and three movable printing units on the right side, all of which can be moved relative to each other the circumference of the counter pressure roller by means of drives.

FIG. 1 depicts a schematic drawing of a flexographic printing machine, which comprises a machine frame, in whose side members 1 is mounted in the usual manner a counter pressure cylinder 2, which is provided with a drive (not illustrated). The insides of the side members 1 of the printing machine frame are provided with guides 3 for the printing unit brackets 4. The guides can be designed in any arbitrary manner and comprise, for example, rings, which are concentric to the axis of the counter pressure cylinder and which are fastened to the insides of the side members 1 of the printing machine frame. These rings 3 can be enveloped by guide shoes 5, which are fastened to the side walls of the printing unit brackets 4. The guides can also comprise ball boxes.

Figure 2:
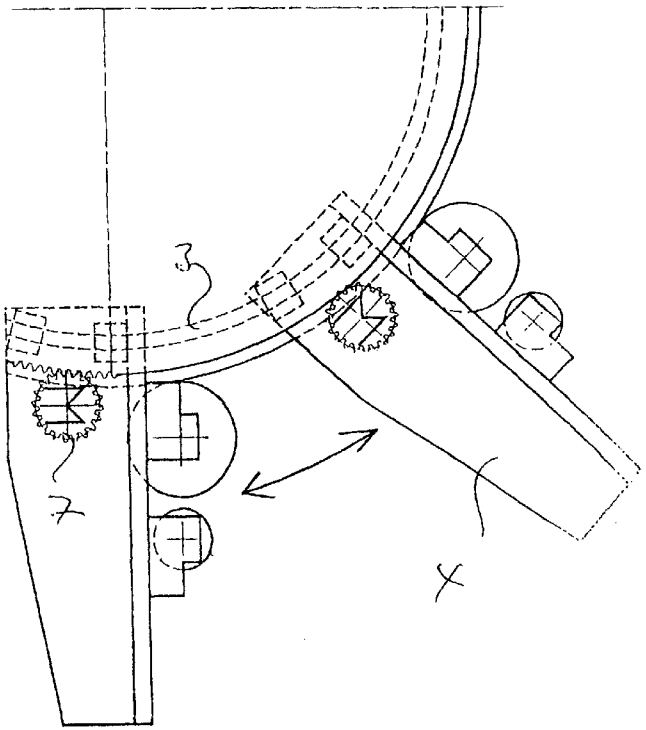
FIG. 2 is a detail of the flexographic printing machine, according to FIG. 1.
Figure 3:
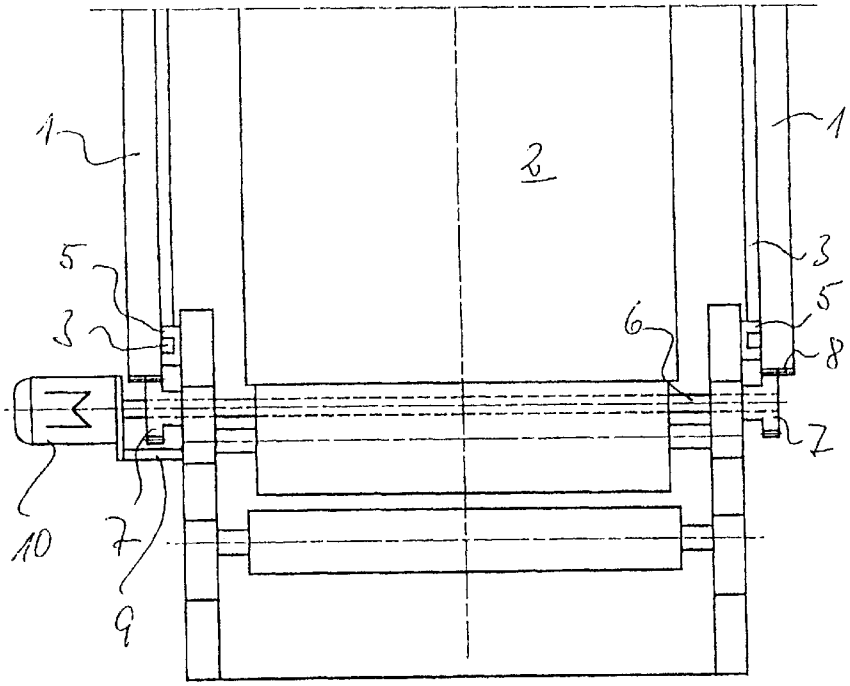
FIG. 3 is a top view of a printing unit, according to FIG. 2.

In the embodiment, according to FIGS. 1 to 3, there are shafts 6, which are mounted in the side walls of the inking unit brackets 4 and whose shaft journals, projecting beyond the side walls, bear pinions 7, which mesh with toothings 8, attached to the side members 1 of the printing machine frame. One of the side walls of the inking unit brackets 4 is connected to a support 9, to which a gear motor 10 is flanged that drives the pinion shaft 6 so that, owing to a corresponding motor control, each of the printing unit brackets 4 can be moved on a circle concentric to the axis of the counter pressure cylinder.

Each of the brackets 4 is provided in the usual manner with bearing blocks, which can be moved in the radial direction and which bear the printing unit rollers 12 and the inking unit or engraved rollers 13. The inking units and/or the ink chamber doctor blades are not illustrated.

The printing unit brackets 4, which can be moved in guide shoes 5 on the guides 3, can be moved preferably into a position, in which they can be pulled out, like drawers, of the printing machine frame and reinserted.

Preferably the station for inserting and removing the printing unit brackets 4 is located on the top side of the printing machine frame. In this area the guide, which runs concentrically to the counter pressure roller, can be interrupted in such a manner that the printing unit brackets can be pushed into the printing machine frame and threaded into the guides.

Figure 4:
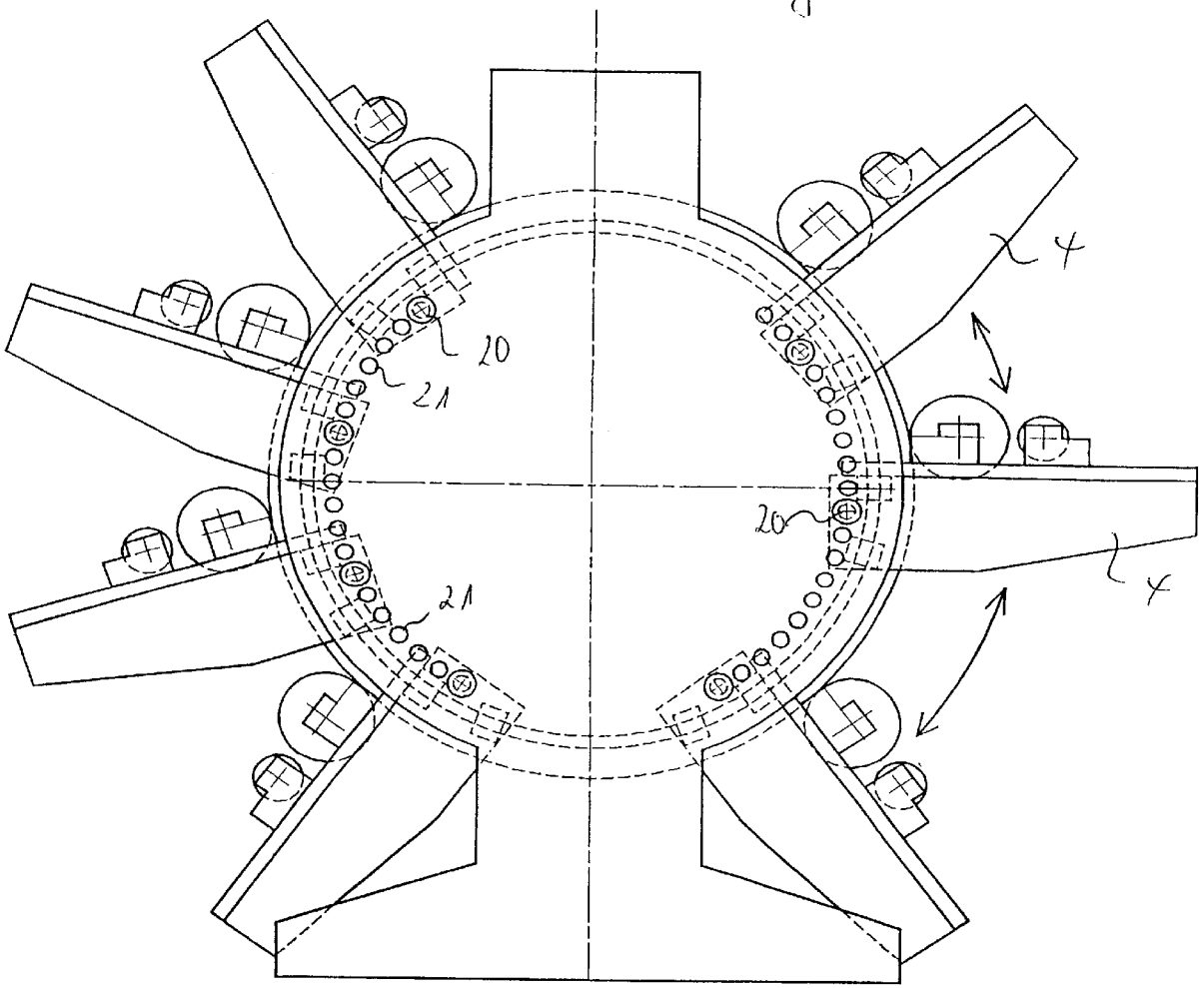
FIGS. 4 to 6 depict drawings, according to FIGS. 1 to 3, according to which the printing units can be moved manually or by auxiliary means over the circumference of the counter pressure cylinder and can be fixed into set positions.
Figure 5:
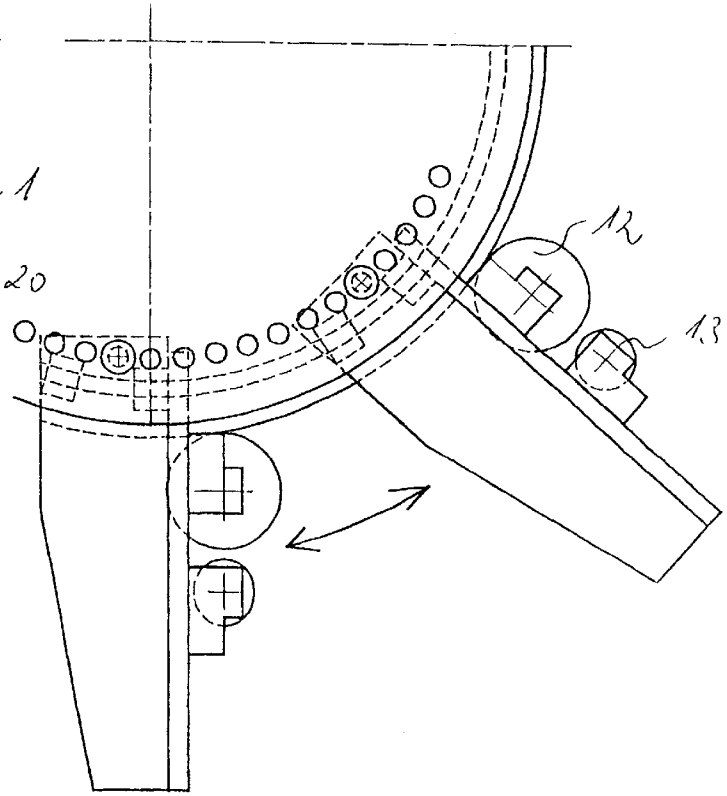
Figure 6:
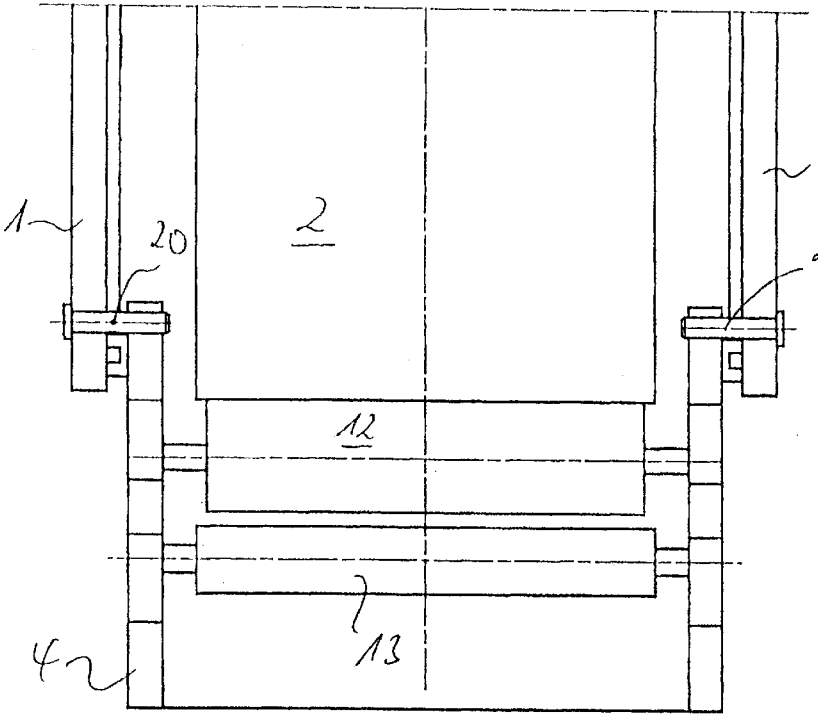

In the embodiment, according to FIGS. 4 to 6, the printing unit brackets 4 can be moved manually or by means of external lifting and/or transport means on their guides, which are designed in principle in the same way as the guides, according to FIGS. 1 to 3. Whereas, according to the embodiment, according to FIGS. 1 to 3, the printing unit brackets can be fixed in any desired position by means of gear motors 10, in the embodiment, according to FIGS. 4 to 6, the printing unit brackets can be fixed, for example, by means of bolts 20 in the desired positions. For this purpose the side members 1 of the printing machine frame are provided with boreholes 21 on a circular line, which is concentric to the axis of the counter pressure cylinder 2. In the positions to be fixed said boreholes are in alignment with boreholes in the side walls of the printing unit brackets 4. Then the printing unit brackets are fixed in the desired positions through insertion of bolts 20, which are then secured in the usual manner.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A flexographic printing machine comprising:

a counter pressure cylinder mounted in a printing machine frame;

a plurality of printing units, each printing unit having a printing roller and related inking roller mounted on a bracket that can be moved in relation to other printing units;

a guide ring on said printing machine frame which is concentric to an axis of said counter pressure cylinder, said brackets being held in said guide ring and being movable therein; and fixing members for fixing the brackets in desired positions along the guide ring.

2. The flexographic printing machine as set forth in claim 1, wherein the brackets can be inserted into and pulled out of the guide ring.

3. The flexographic printing machine as set forth in claim 1, wherein each printing unit has an associated drive unit.

* * * * *